United States Patent [19]

Toronto, Ontario

[11] 4,070,017

[45] Jan. 24, 1978

[54] HOCKEY PRACTICE SHOOTER

[76] Inventor: Ralph Lombardi, 167 Sheldon Ave., Toronto, Canada

[21] Appl. No.: 699,270

[22] Filed: June 24, 1976

[30] Foreign Application Priority Data

July 15, 1975 Canada ..... 231510

[51] Int. Cl.[2] ..... A63B 69/00

[52] U.S. Cl. ..... 273/1 B; 273/184 R

[58] Field of Search ..... 273/1 B, 184

[56] References Cited

U.S. PATENT DOCUMENTS

| | | | |
|---|---|---|---|
| 1,581,402 | 4/1926 | Panfrase | 273/184 R |
| 1,721,041 | 7/1929 | Rotermond | 273/184 B |
| 1,799,009 | 3/1931 | Earley et al. | 273/184 B |
| 3,955,815 | 5/1976 | Deschesnes | 273/1 B |

*Primary Examiner*—Paul E. Shapiro
*Attorney, Agent, or Firm*—George H. Riches

[57] ABSTRACT

This invention relates to a device which may be conveniently installed in a desired location on a flat surface to permit practice shooting of a hockey puck in rapid succession to develop technique, coordination and strength. In an alternate embodiment, the invention also provides an indicator of the relative power with which the puck is shot. The device includes a hollow elongated track which may be fixed to a floor or the ground, a puck rotatably attached to a wheeled carriage and a spring loaded plunger fixed to one end of the track. The carriage is located inside the hollow track and rolls freely up and down the track carrying the puck in a horizontal plane slightly above the track. In use, the puck is shot along the track towards the plunger. When the puck strikes the plunger, the momentum of the puck and carriage compresses the spring which then expands to return the puck along the track to its original position. In the alternate embodiment, an upwardly extending indicating scale is fixed to the track adjacent the plunger, and receipt of the puck by the plunger operates to transfer some of the momentum of the puck and carriage to an indicator which is projected upwardly along the indicating scale. The maximum height reached by the indicator on the scale provides the shooter with an indication of the relative velocity or power at which he shot the puck. In a further embodiment without the indicating scale, the spring loaded return plunger may be replaced by a member formed of a suitable resilient material such as rubber, from which the travelling puck rebounds to its original position.

3 Claims, 8 Drawing Figures

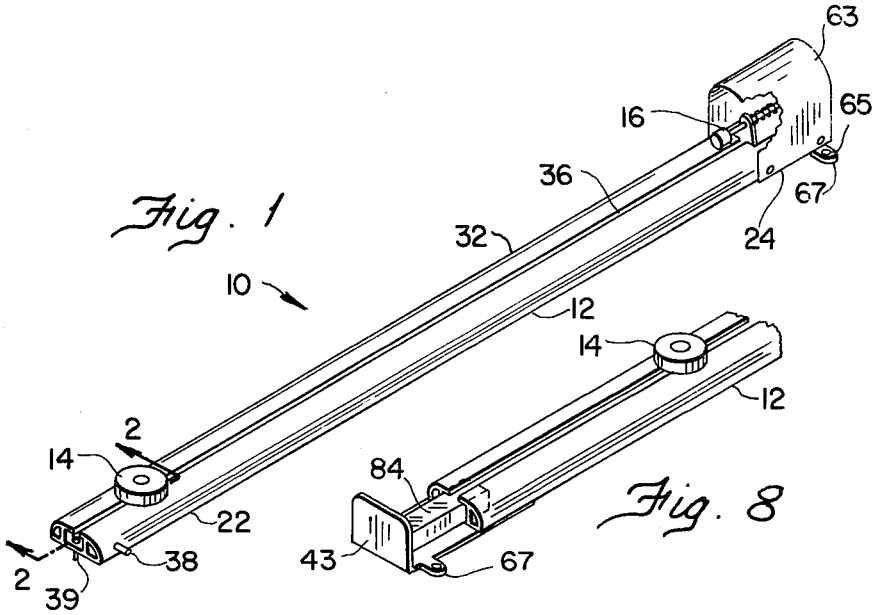
Fig. 1
Fig. 8
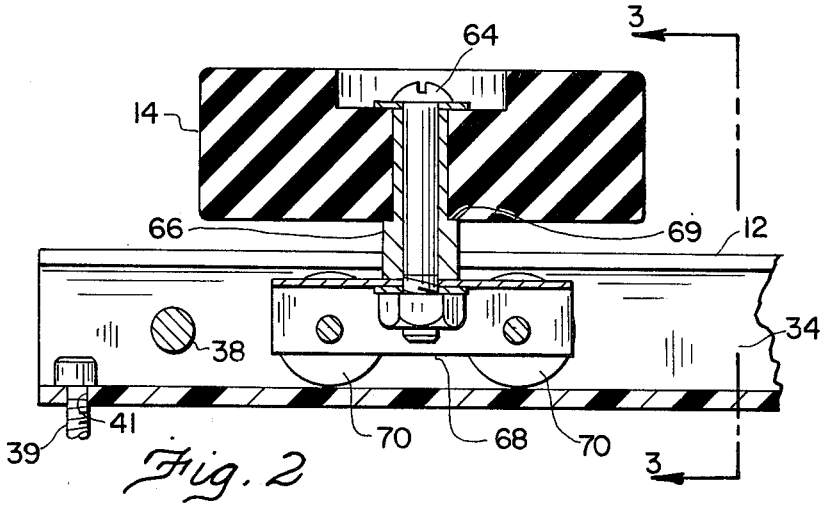
Fig. 2
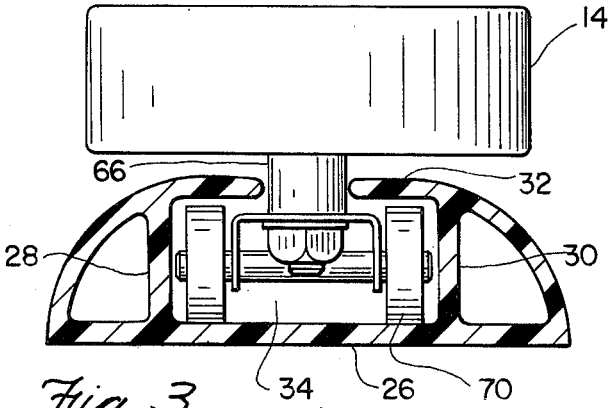
Fig. 3

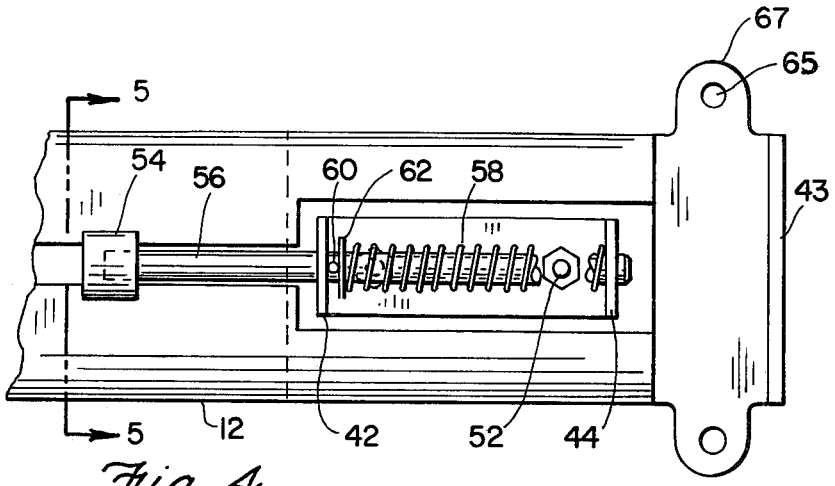
Fig. 4
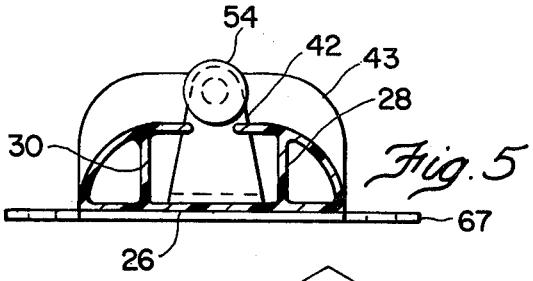
Fig. 5
Fig. 6
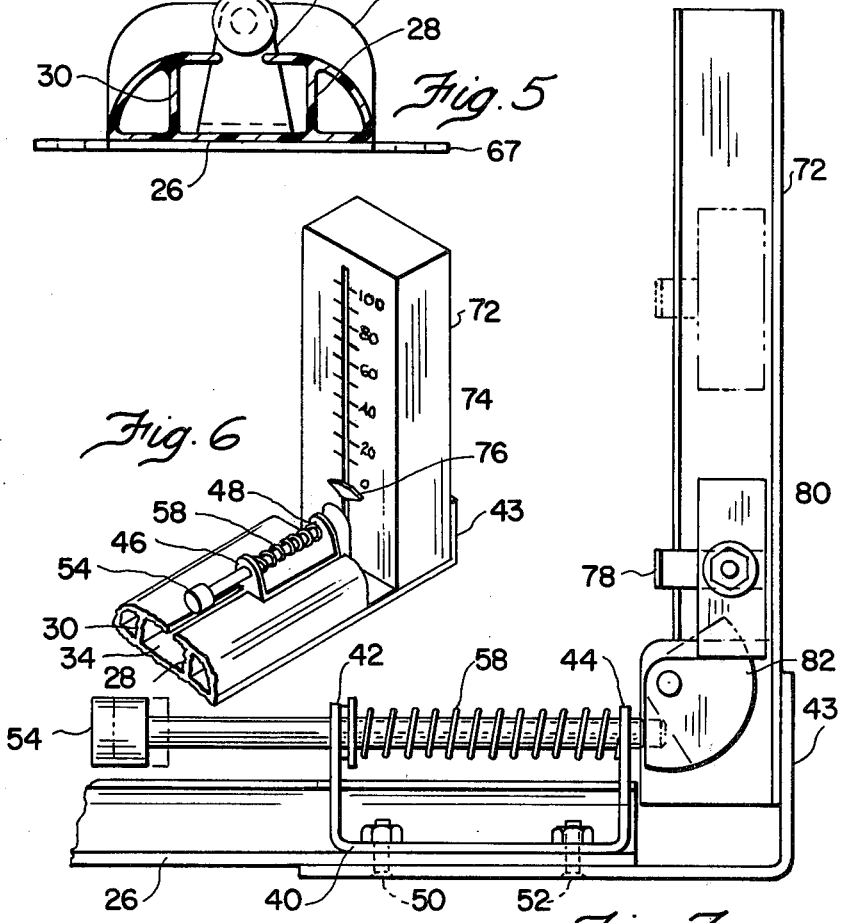
Fig. 7

HOCKEY PRACTICE SHOOTER

BACKGROUND OF THE INVENTION

This invention relates to a hockey puck practice shooting device and more particularly to such a device which will return the puck to its initial position to permit rapid successive practice shots.

In the past, it has been a well known training technique in a variety of sports to repeatedly perform a particular aspect of the game in order to develop technique, coordination and strength. Examples of this are serving in tennis, batting in baseball and driving in golf. While this type of training is particularly advantageous for young developing players, one of the problems in providing equipment for it is to adequately simulate actual conditions in a manner which may be made conveniently available to a large number of players.

In hockey, this problem is amplified by the fact that the game is played on ice which causes practice availability to be seasonally restricted and, as well, very expensive. On actual ice conditions it is well known to practice shooting a hockey puck in rapid succession by lining up a number of pucks and shooting them in sequence. This same technique has been used on a simulated surface when ice is not available, but in addition to locating a suitable surface, it necessarily involves the disadvantages of acquiring a large number of pucks and retrieving them each time after they have been shot.

SUMMARY OF THE INVENTION

Accordingly, it is an object of the present invention to at least partially overcome these disadvantages by providing a hockey puck practice shooting device which may be mounted on a convenient flat horizontal surface and which utilizes a single puck which is quickly returned to its initial position for practice shooting in rapid succession.

To this end, in one of its aspects, the invention provides a hockey puck practice shooting device comprising puck means movable from a starting position; longitudinal track means to engagingly receive the puck means to restrict travel of the puck means along the track means, the track means having a first shooting end and a second return end and being adapted to be located in a desired position on a substantially horizontal surface; and return means attached to the track means to return the puck means substantially to the starting position adjacent the first end of the track means.

In another of its aspects, the invention further provides a hockey puck practice shooting device comprising puck means having a puck rotatably mounted above a puck carriage having four wheels by a pin extending between the puck and the carriage; longitudinal track having securing means to fixedly secure the track means to a substantially flat horizontal surface, the track having a first shooting end, a second return end, and a longitudinal channel having an upwardly opening uniform T-shaped cross section, the puck carriage being located in the channel whereby rolling motion of the carriage along the channel carries the puck in a path through a horizontal plane above the track; return means secured to the track adjacent the second end thereof, the return means including a plunger having a head and a shaft longitudinally located in the path of the puck with the head directed to receivingly contact the puck arriving from the direction of the first end of the track, the return means further including a spring positioned around the shaft of the plunger to act in compression to return the puck to a position adjacent the first end of the track; and puck velocity indicating means fixedly secured to the second end of the track to indicate the relative velocity at which the puck arrives at the second end of the track comprising an indicating scale extending upwardly adjacent the second end of the track, an indicator slidably secured to the indicating scale to be propelled upward along the indicating scale to a maximum position indicating the relative velocity of the puck, and pivotal means pivotally attached to the indicating scale adjacent the second end of the track in contact with the plunger rod and the indicator whereby receipt of the travelling puck by the plunger head drives the plunger rod against the pivotal means which in turn propells the indicator vertically upward along the indicating scale to indicate the relative velocity of the travelling puck.

Further objects and advantages of the invention will appear from the following description taken together with the accompanying drawings.

BRIEF DESCRIPTION OF THE DRAWINGS

FIG. 1 is a perspective view of a first embodiment of the invention;

FIG. 2 is a sectional view taken along line 2—2 in FIG. 1;

FIG. 3 is a sectional view taken along line 3—3 in FIG. 2;

FIG. 4 is a partial plan view of the embodiment shown in FIG. 1 with the cover removed;

FIG. 5 is a sectional view along line 5—5 in FIG. 4;

FIG. 6 is a partial perspective view of a second embodiment of the invention;

FIG. 7 is a partial sectional view of the embodiment of the invention shown in FIG. 6; and FIG. 8, (located on same page as FIG. 1) is a perspective view of a third embodiment of the invention.

DESCRIPTION OF THE PREFERRED EMBODIMENTS

Reference is first made to FIG. 1 which shows a practice puck shooting device 10 having an elongated track 12, a puck 14, and a puck return plunger 16. The track 12 is of a predetermined length, normally between 4 and 20 feet, and may be secured in a desired position to a flat horizontal surface.

The track 12 has a shooting end 22 and a return end 24 and is conveniently and economically formed of a suitable extruded plastic to have a uniform cross section, although it may also be formed of metal or wood. As best seen in FIG. 3, the track 12 has a base 26, vertical reinforcing ribs 28, 30, and a flat top 32 which define an elongated channel 34 having a rectangular cross section which opens upward through elongated shot 36 in the flat top 32. The track 12 has a removable stop pin 38 extending across its shooting end 22. A screw 39 (or pin) may be inserted through hole 41 in the base 26 of the track 12 to secure the shooting end of the track against lateral movement during use.

As best seen in FIGS. 4 and 5, an L-shaped member 43 and a U-shaped member 40 having two spaced flanges 42, 44 extending vertically upwardly therefrom with horizontally aligned apertures 46, 48 therethrough are attached to the elongated track 12 adjacent its return end 24 by bolts 50, 52. The return plunger 16 has a head 54 and a shaft 56 which is received through the apertures 46, 48 to reciprocally position the plunger 16 in horizontal alignment with the track 12, with the head 54 located above the slot 36 and facing in the direction of the shooting end 22. A coil spring 58 is located around the plunger shaft 56 between the flanges 42, 44. A removable pin 60 extends through the plunger shaft 56 and a washer 62 around the shaft is in bearing contact between the pin 60 and the spring 58. The pin 60 provides a stop against flange 42 to axially retain the plunger shaft 56 in the apertures 46, 48, and as well transfers the compression force of the spring 58 from the washer 62 to the plunger shaft 56. Cover 63 is removably attached to partially enclose the spring 58 for the sake of appearance and to reduce the entry of dirt into the area of the spring. Bolts or pins may be inserted through holes 65 in ears 67 on the L-shaped member 43 to additionally secure the device against movement during use.

The puck 14 is rotatably attached by bolt 64 extending through sleeve 66 to a carriage 68. As may be seen, the puck 14 is vertically supported above the carriage 68 by shoulder 69 on sleeve 66 which abuts on the lower surface of the puck. The carriage 68 is inserted into elongated channel 34 past removable stop 38 and the bolt 64 and sleeve 66 project upwardly through slot 36. The carriage 68 has four TEFLON* coated wheels 70 which ride on the base 26 of the track to allow the carriage 68 to move freely back and forth along the channel 34 to carry the puck 14 along the track 12 in a horizontal plane slightly spaced above the flat top 32 of the track in alignment with the return plunger 16.

* Trade Mark

In use, the track 12 is positioned in a desired location on a horizontal surface such as the floor of a basement or the ground in a yard and is preferably secured to the surface by the screws or pins mentioned above. If a permanent installation is made, it may be desirable to locate the track 12 in an elongated trench (not shown) in the horizontal surface to have the top 32 of the track flush with the horizontal surface. The puck 12 is positioned at a desired location towards the shooting end 22 of track 12 and then shot with a hockey stick towards the return end 24 of the track 12. The puck 14 travels along the track under condition simulating those of travelling on an ice surface and strikes the head 54 of the plunger 16. The momentum of the travelling puck 14 and carriage 68 acts to compress the spring 58 until the puck 14 comes to a stop, at which time the springs expands to transfer its potential energy back to the puck 14 to immediately return it down the track towards the shooting end 22. It will be apparent that the momentum of the returning puck is dependent upon the velocity at which it is travelling when it strikes the head 54 of the plunger 16 and the characteristics of the compression spring 58. While the compression spring 58 is selected to return the puck and carriage substantially to their initial position for an average shot, on a shot which is stronger or weaker than average, the shooter may stop the returning puck and move it with his stick to a desired position for the next successive shot. If he fails to stop the puck on a strong shot, stop pin 38 will prevent the puck and carriage from travelling off the shooting end of the track.

FIGS. 6 and 7 partially illustrate the structure of a second embodiment of the puck practice shooting device. As many of the features (including those not shown) are identical to those of the first embodiment, features common to both embodiments are described and illustrated using the same reference numerals. In this second embodiment, an enclosed rectangular upwardly extending velocity indicating scale 72 is fixed to the track 12 at the return end 24 by bolts 50, 52. As may be seen, the indicating scale 72 is calibrated vertically upward from 0 to 100 along an elongated gap 74 in the front of the scale. This embodiment includes an indicator 76 having a pointer 78 which extends through the gap 74 to the front of the indicating scale 72 and a weight 80 enclosed in the rectangular indicating scale to which the pointer 78 is fixed. Segmental pivotal member 82 is pivotally attached to the lower end of the indicating scale in a position aligned between the plunger shaft 56 and the weight 80.

In use, the puck 14 is shot towards and returned by the plunger 16 in an identical manner to that described above in regard to the first embodiment. However, additionally as the spring 58 compresses, the plunger shaft 56 pivots the pivotal member 82 counter-clockwise (as seen in FIG. 7). The pivotal member 82 in turn is in bearing contact with weight 80, and a portion of the horizontal momentum of the puck and carriage is thereby transferred to the indicator to project the indicator 76 vertically upward along the indicating scale 72. The weight of the puck and carriage and the other structural components being predetermined, the maximum distance which the indicator 76 travels upward along the indicating scale 72 in an indication of the relative velocity at which the puck was travelling when it struck the plunger. The device may, of course, be calibrated to indicate the actual power or shooting velocity by varying the structural components, such as the size of weight 80.

FIG. 8 partially illustrates the structure of a further embodiment of the invention. As mentioned above in regard to the second embodiment, many of the features (including those not shown) are identical to those of the first embodiment and therefore common reference numerals are used. In this embodiment, the plunger and coil spring shown in the other embodiments have been replaced by a resilient member 84 which may be formed of a suitable rubber material. The resilient member 84 is secured to the L-shaped member 43 to extend into the elongated channel 34 adjacent the return end 24 of the track 12. During use, the travelling carriage 68 strikes the resilient member 84 and immediately rebounds to its initial position adjacent the shooting end 22 of the track 12. It is apparent that the resilient member 84 may extend above the track 12 through slot 36, in which case it is struck by the puck 14 above the track rather than by the carriage inside the track.

Although the disclosure describes and illustrates two preferred embodiments of the hockey puck practice shooting device according to the invention, it is to be understood that the invention is not restricted to those particular embodiments. In particular, it is apparent that a spring may be attached between the shooting end 22 of the track 12 and the carriage 68 to act in tension to return the puck to the initial position, rather than coil spring 58. Additionally, other equally suitable carriage means may be used to simulate actual ice conditions. Furthermore, various alternate structures of the indicating means would be apparent to a person skilled in the art.

What I claim is:

1. A hockey puck practice shooting device comprising:

a. puck means including a practice puck and a wheeled puck carriage, and connection means for rotatably mounting said practice puck above said puck carriage;

b. elongated track means having a width less than about twice the width of said practice puck and comprising a first shooting end and a second return end and adapted to be located in a desired position on a substantially horizontal surface, said track means having a substantially uniform cross-section and defining a longitudinal channel having an upwardly opening longitudinal slot, the track means in cross-section having rounded upper outer corners, said corners having a radius of curvature which is of the general order of magnitude of the height of said track means, said channel wider than said puck carriage, said slot narrower than said puck carriage, said channel defined in part by substantially flat webs extending the length of said slot on either side thereof, sand channel engagingly receiving said puck carriage to restrict travel thereof to travel along said track means, said practice puck slightly spaced above said track means, said connection means extending through said longitudinal slot, whereby as the puck carriage moves along the longitudinal channel in the track means the puck is rotatably carried in a horizontal plane slightly spaced above the track means simulating movement of a puck on an ice surface; said track means made of extruded plastic and permitting said webs and said entire track means to flex to absorb the force of blows upon said puck means and upon said track means; and c. return means attached to the track means adjacent the second end of the track means to engage a puck which has been shot from said first end to said second end to return the puck to said first end, d. stop means attached to the track means adjacent the first end of the track means to prevent a returned puck means from passing out of said track means, said puck means, said track means and said return means cooperating to quickly return a shot puck to its starting position for practice puck shooting in rapid succession.

2. A hockey puck practice shooting device as claimed in claim 1 wherein the return means comprises a resilient member secured in a position to resiliently receive the puck means arriving from the direction of the first end of the track means, the resilient member being formed of a suitable material to rebound the puck means substantially to the starting position.

3. A hockey puck practice shooting device as claimed in claim 1 further comprising velocity indicating means to indicate the velocity at which the puck means is travelling along the track means at a predetermined position, the velocity indicating means comprising:

i. an indicating scale fixedly secured to the track means to extend vertically upward adjacent the second end of the track means, ii. an indicator which travels upward along the indication scale to a maximum position indicating the velocity of the puck means, and iii. momentum translation means located adjacent the second end of the track means between the return means and the indicator, said momentum translation means including pivotal means attached to the device whereby horizontal momentum imparted by receipt of the puck means by the return means is translated to vertical momentum in the indicator to project the indicator vertically upward over the indicating scale.

* * * * *